US011346007B2

(12) United States Patent
Hesebeck et al.

(10) Patent No.: US 11,346,007 B2
(45) Date of Patent: May 31, 2022

(54) WORKPIECE WITH IMPROVED COATING

(71) Applicant: Danfoss Power Solutions GmbH & Co. OHG, Neumunster (DE)

(72) Inventors: Mareike Hesebeck, Kiel (DE); Marc Diesselberg, Ehndorf (DE); Galina Haidarschin, Neumunster (DE)

(73) Assignee: Danfoss Power Solutions GmbH & Co. OHG, Neumünster (DE)

( * ) Notice: Subject to any disclaimer, the term of this patent is extended or adjusted under 35 U.S.C. 154(b) by 267 days.

(21) Appl. No.: 15/763,313

(22) PCT Filed: Apr. 18, 2017

(86) PCT No.: PCT/EP2017/059135
§ 371 (c)(1),
(2) Date: Mar. 26, 2018

(87) PCT Pub. No.: WO2017/190941
PCT Pub. Date: Nov. 9, 2017

(65) Prior Publication Data

US 2018/0282878 A1 Oct. 4, 2018

(30) Foreign Application Priority Data

May 6, 2016 (DE) ..... 10 2016 108 408.5

(51) Int. Cl.
*C23C 30/00* (2006.01)
*F04B 1/122* (2020.01)
(Continued)

(52) U.S. Cl.
CPC ..... *C23C 30/005* (2013.01); *C22C 27/04* (2013.01); *C23C 4/06* (2013.01); *C23C 4/08* (2013.01);
(Continued)

(58) Field of Classification Search
None
See application file for complete search history.

(56) References Cited

U.S. PATENT DOCUMENTS 3,690,686 A * 9/1972 Prasse ..... F16J 9/26 277/444
4,599,861 A * 7/1986 Beaumont ..... F02B 71/045 123/46 SC
(Continued)

FOREIGN PATENT DOCUMENTS

CN 102787933 A 11/2012
DE 3515107 C1 7/1986
(Continued)

OTHER PUBLICATIONS

Oerlikon Metco Material Product Data Sheet: Molybdenum—Nickel Chromium Iron Boron Silicon Powder Blend for Thermal Spray, 2014 (https://www.oerlikon.com/ecomaXL/files/metco/oerlikon_DSMTS-0107.0_Mo-NiCrFeBSiC_Blend.pdf&download+1) (Year: 2014).*
(Continued)

*Primary Examiner* — Robert S Jones, Jr.
*Assistant Examiner* — Jiangtian Xu
(74) *Attorney, Agent, or Firm* — McCormick, Paulding & Huber PLLC

(57) ABSTRACT

The invention relates to a metallic work-piece (2, 5, 6, 14, 20, 23) for a hydraulic device (1, 15). The workpiece (2, 5, 6, 14, 20, 23) comprises a coating layer (12), characterized in that the coating layer (12) contains Mo, in particular metallic Mo, with a weight fraction of at least 1%.

10 Claims, 2 Drawing Sheets

(51) Int. Cl.

| | |
|---|---|
| ***F04B 1/2014*** | (2020.01) |
| ***F03C 1/06*** | (2006.01) |
| ***C23C 4/08*** | (2016.01) |
| ***C22C 27/04*** | (2006.01) |
| ***C23C 4/06*** | (2016.01) |

(52) U.S. Cl.
CPC ..... *C23C 30/00* (2013.01); *F03C 1/0602* (2013.01); *F04B 1/122* (2013.01); *F04B 1/2014* (2013.01); *F05B 2230/90* (2013.01); *F05B 2280/10303* (2013.01); *F05B 2280/6011* (2013.01); *F05C 2201/0409* (2013.01); *F05C 2253/12* (2013.01)

(56) References Cited

U.S. PATENT DOCUMENTS

| | | | | |
|---|---|---|---|---|
| 4,756,841 | A | 7/1988 | Buran et al. | |
| 6,652,674 | B1 * | 11/2003 | Woodard | C22C 1/045 148/423 |
| 7,438,979 | B2 | 10/2008 | Takayama et al. | |
| 8,876,936 | B2 * | 11/2014 | Kim | B22F 5/106 419/39 |
| 2012/0119132 | A1 * | 5/2012 | Gradischer | C23C 4/08 251/366 |

FOREIGN PATENT DOCUMENTS

| | | | |
|---|---|---|---|
| EP | 0858519 | B1 | 5/2000 |
| JP | 2001140039 | * | 8/2004 |
| JP | 2004346417 | A | 12/2004 |

OTHER PUBLICATIONS

"Thermal Spray Materials Guide", 2015 (https://sites.ualberta.ca/~andre2/andre/documents/researchResource/ThermalSprayMaterialsGuide.pdf) (Year: 2015).*
Oerlikon Metco Material Product Data Sheet: High Carbon Iron-Molybdenum Composite Powder, 2014 (https://www.oerlikon.com/ecomaXL/files/metco/oerlikon_DSMTS-0046.1_FeMoC_Comp.pdf) (Year: 2014).*
JP2001140039 machine translation (Year: 2021).*
Manjunatha ("Effect of powder particle size on wear resistance of plasma sprayed molybdenum coating", Proc IMechE Part J: J Engineering Tribology 2014, vol. 228(7) 789-796). (Year: 2014).*
Vestman et al. ("Hydrocone Crusher, a new fast robust design of the hydraulic system", 2008) (Year: 2008).*
"Material Product Data Sheet: High Carbon Iron-Molybdenum Composite Powder," Oerlikon Metco, pp. 1-3 (2014).
"Material Product Data Sheet: Molybdenum-Nickel Chromium Iron Boron Silicon Power Blend for Thermal Spray," Oerlikon Metco, pp. 1-3 (2014).
International Search report for Serial No. PCT/EP2017/059135 dated Jun. 7, 2017.

* cited by examiner

WORKPIECE WITH IMPROVED COATING

CROSS-REFERENCE TO RELATED APPLICATIONS

This application is a National Stage application of International Patent Application No. PCT/EP2017/059135, filed on Apr. 18, 2017, which claims priority to German Patent Application No. 10 2016 108 408.5, filed on May 6, 2016, each of which is hereby incorporated by reference in its entirety.

TECHNICAL FIELD

The invention relates to a workpiece for a hydraulic device that comprises at least in part a coating layer. Furthermore, the invention relates to a hydraulic device and/or a fluid working machine, comprising at least one workpiece that comprises at least in part a coating layer.

BACKGROUND

Each time, when two surfaces of two different workpieces are in contact with each other, friction occurs. Initially, this friction hinders the movement of the respective workpieces, necessitating a comparatively high force to start a movement of the two workpieces relative to each other. As soon as movement has started, due to friction a mechanical wear of the two contacting surfaces inevitably occurs. This wear will ultimately result in the necessity of maintenance work (for example, the respective workpieces have to be replaced at a certain point), because otherwise at some point failure of the machinery will result. But even before failure occurs, the described wear (and in particular abrasion) of the respective surfaces will usually result in lower efficiency of the machine (for example due to higher losses of lubricant due to increased gaps), generation of noise (due to vibration, in particular due to a higher possible amplitude for vibrating parts), and the like, so that preventive maintenance sometimes has to be performed at a pretty early stage.

Due to the function of the respective device, in which the workpieces are used, a relative movement of two machine parts (workpieces) usually cannot be avoided (because otherwise the machine would be inoperative). Therefore, other approaches have been suggested in the state of the art to reduce friction, thus prolonging maintenance intervals and increasing the performance of the device.

A standard approach that is used in a plethora of technical fields is the use of lubricants. Thus, a thin fluid film is used at the interface of the two moving parts. As such fluids, a variety of oils (mineral oil, synthetic oil, a mixture of both and the like) are typically employed. However, the use of different types of fluid is also known in the state of the art. For example, in some applications a fluid layer consisting (mainly) of a gas (i.e. a thin gas film) is used for lubricating purposes as well.

While this approach is the usual approach which works well in practice, it also has some disadvantages. In particular, an effective reduction of friction due to lubrication of the interface between the neighbouring parts will typically start only when the two surfaces of the workpieces move with a certain speed relative to each other. Then, so-called hydrodynamic lubrication occurs. At lower speeds, however, only so-called boundary lubrication occurs (which shows an increased friction and thus results in a higher wear). Between the two regimes, mixed lubrication occurs. The intrinsic problem of these regimes is that they somehow contradict, so that a compromise has to be designed. For completeness, it should be mentioned that under certain conditions dry friction can occur as well.

In particular, to reduce friction (hydrodynamic lubrication) at higher speeds, oil with a low viscosity should be chosen. However, if the oil has a low viscosity, it is usually less adhesive and thus does not stick as well to the surface of the workpiece. This has the consequence that in the low-speed regime (boundary lubrication and/or mixed lubrication) usually a higher friction occurs, resulting in a higher wear. Thus, a compromise has to be found for the oil to be chosen, where the compromise depends highly on operating characteristics of the machinery in question.

Another problem is that an oil film disappears from the surface of a machine that is not operating after a comparatively short time span. If the machine is not operating, of course a lubricating oil pump that pumps oil to the surfaces that have to be lubricated is inoperative as well. A typical time span for a surface to become dry is one to two days. After this period, typically the surface parts of a device show essentially no fluid coating and thus no fluid lubrication anymore. If the machine is started, for the initial time span a comparatively high friction and wear (inevitably) occurs, since the respective surface parts are in direct contact with each other (no fluid surface in between) for the initial phase of start-up (typically a few seconds). The same situation of a direct surface-to-surface contact (without any fluid film in between) can occur if a failure of (part of) the machinery occurs (for example failure of an oil pump) or even with an operative device under disadvantageous operating conditions.

Therefore, for devices that necessitate a higher reliability and an increased lifetime, some additional measures have to be provided. A typical example for such an "additional measure" is the use of a special coating for the surface areas that are in moving contact with each other.

Depending on the field of technology and thus the operating conditions of the contacting surfaces, a variety of surface coating layers have already been proposed.

A particular field in technology is the field of fluid working machines (fluid pumping devices and/or fluid motoring devices, in particular hydraulic fluid pumps and/or hydraulic fluid motors). In this field, a variety of designs for fluid working machines exist. A sort of "challenging" design of fluid working machines (at least when it comes to surface coatings), are bent axis motors/bent axis pumps (including the further developed design of fluid working machines with a variable tilt angle of the tilted plate; this is referred to as a wobble plate). This is, because here by design a pin to surface contact is present. Therefore, apart from the necessities of good lubrication, a high mechanical force/pressure is existent. Therefore, one has to take into account several parameters. In particular, a low friction has to be present (with and without a fluid layer between the contacting surfaces), a good wettability of the surfaces with respect to the used lubricating fluid has to be present, a high mechanical resistance has to be present (low wear of the parts involved); and the respective coatings have to be able to tolerate a high mechanical force/high mechanical pressure (in particular without any so-called ploughing effects/deformation effects).

So far, for this field of technology bronze coatings are used, where the bronze typically contains a certain percentage of lead. With increasing environmental awareness, however, the content of lead poses an increasing problem. In particular, it can be expected that the allowable lead content will be decreased over time by the legislator. Even a complete ban of any lead content has to be expected in the near future, at least under certain jurisdictions.

Therefore, there is an urgent need for a surface coating that shows good (or at least acceptable) mechanical properties, but that has no (or at least very little) lead content.

SUMMARY

Therefore, it is an object of the invention to propose a workpiece for a hydraulic device that comprises a coating layer, where the coating layer is improved over coating layers that are known in the state of the art. It is another object of the invention to propose a hydraulic device and/or a fluid working machine, comprising at least one workpiece that shows at least in part a coating layer that is improved over coating layers that are known in the state of the art.

The invention according to the independent claims solves these objects.

It is suggested to design a workpiece for a hydraulic device that comprises at least in part a coating layer in a way that the coating layer contains Mo, in particular metallic Mo, with a weight fraction of at least 1%. Although the workpiece that is intended to be used for hydraulic device can be essentially made of any material (just to name a few examples: a ceramic material, a resin material, a plastic material, a rubber material, a (carbon) reinforced fibre material, metal and the like; a mixture of two or more constituents of this list and/or possibly of even more substances is possible as well), it is usually advantageous if the workpiece is a metallic workpiece, i.e. that the basic material (that usually forms the basic structure of the respective material) is made of a metal. The metal can be essentially any metal. However, it is advantageous if it is made of metal that is regularly used for machines, for example iron, steel, stainless steel, copper, aluminium and the like (including, but not limited, alloys comprising one, two or even more of the previously mentioned metals and presumably some other materials and/or metals). The workpiece comprises at least one coating layer. In case a plurality of coating layers is provided (which is of course possible), those coating layers can be stacked "on top of each other" and/or they can be arranged on different surface areas of the workpiece ("side by side"). By the notion "comprising at least in part a coating layer", it has to be understood that not necessarily the complete surface of the workpiece has to comprise a coating layer. Instead, it is usually sufficient that the coating layer is arranged only on a fraction of the overall surface area of the workpiece, for example in form of one, two, three or even more "patches". In particular, the patches can advantageously cover (at least) those surface areas, where typically a surface contact to another workpiece takes place and/or can be expected to take place (in particular under more or less normal operating conditions of the complete device), possibly adding a "safety margin". To give some numbers about the fraction of the overall surface area of a certain part that can be covered with a surface coating layer: the surface coating layer (at least one of the plurality of surface coating layers) and cover at least 0%, 10%, 20%, 30%, 40%, 50%, 60%, 70%, 80% 90% and/or up to 10%, 20%, 30%, 40%, 50%, 60%, 70%, 80%, 90% or 100%. Of course, it is possible that the coating layer (including the possibility of one or several patches of coating layers) shows essentially the same thickness. However, it is also possible that different thicknesses are used. To name a particular example, the coating layer can show a comparatively high thickness in a first fraction of the overall surface area, the coating layer can show a second, comparatively thin thickness in a second fraction of the overall surface area and in a third fraction of the overall surface area (essentially) no coating layer can be foreseen. It is even possible that even a fourth, fifth, sixth and so fraction of the overall surface area on shows coating layers of varying thicknesses as well. Furthermore, the first, the second and/or the third of the previously described coating layers can be dispensed with. To continue with the example of three surface fractions ("patches"), the first surface fraction with a comparatively thick coating layer can be arranged in regions, where a surface contact will frequently take place. The second surface fraction with a comparatively thin coating layer can be arranged in surface areas, where a surface contact can be expected less frequent (for example from time to time), while the third surface fraction with an extremely thin surface layer or no surface layer at all can be arranged in areas, where a surface contact is rarely expected (if at all). As mentioned, it is suggested that the coating layer contains Mo (i.e. molybdenum). The molybdenum can be present in essentially any form. For example, the molybdenum can be present in form of a chemically ligated part of a molecule (where this molecule can be one of several compounds of a mixture of different materials). Preferably, however, the molybdenum is additionally and/or alternatively present in form of metallic molybdenum. How (metallic) Mo is contained in the surface coating is essentially arbitrary. As an example, it can be present in form of small metallic droplets in a mixture of several compounds. However, it can be part of an alloy as well (where alloy cannot only be understood in a "narrow" sense, where essentially all constituents of the "overall material" are metals (or at least semi-metals); instead, it is also possible that "alloy" is to be interpreted in a broad sense, where all types of constituents of the material mix are "allowed"). In particular, it is possible that molybdenum is part of a ceramic material mix and/or that molybdenum is part of a sintered material. It is once again noted that several layers and/or several "patches" (i.e. aside from each other) can be foreseen, where the different layers and/or different patches can be different, not only with respect to thickness, but also with respect to the material chosen (including the fraction of the respective compounds). As already mentioned, the Mo should show a weight fraction of at least 1% (typically, but not necessarily, including 1% itself). First experiments have shown that the resulting coating layer shows a particularly advantageous behaviour, if molybdenum is present. In particular, by using even a small fraction of molybdenum in the material mix (as presently potentially suggested) it is even possible to significantly reduce (and usually even to essentially completely avoid the use of) lead. Thus, present and future legislation can be dealt with, without unduly reducing the quality of the surface coating, and hence of the overall device (including the possibility of even increasing the reliability of the respective part(s), as it can be frequently realised). If the respective (metallic) workpiece is used for a hydraulic device, the use of molybdenum in the coating layer can show even more of its intrinsic properties and advantages, as first experiments have proven. In particular, the wettability of the coating layer is at least sufficiently high (and frequently even very high), when it comes to standard hydraulic oils. Therefore, the respective surfaces do not dry very fast, so that dry friction can be reduced, typically even significantly. Furthermore, using molybdenum as a constituent of the coating layer, usually a particularly wear-free coating layer can be realised that is usually very resistant toward "point-like forces" (i.e. with respect to high forces and/or high mechanical pressures that act on only a small surface area). This characteristic of the resulting coating layer is typically very welcome when it comes to hydraulic machines, in particular fluid working machines having a tilted plate that is in contact with piston feet.

The thickness of the coating layer (at least one of the plurality of coating layers) is preferably in the range of approximately 200 μm. If a coating layer of such a thickness is applied, the fundamental mechanical characteristics of the workpiece are still similar to its uncoated equivalent (i.e. with respect to mechanical strength and so on), while the advantages of the surface coating, in particular with respect to abrasion strength and wear resistance, are already present (in particular a significant increase in strength will not increase those parameters significantly, at least under typical conditions; additionally or alternatively, even if only a thin coating layer is present, in particular in the range of approximately 200 μm as presently suggested, the coated workpieces usually show a high abrasion strength and wear resistance, even if high forces are present—normally no further thickening of the coating layer is necessary, albeit this is of course possible). Furthermore, cost can still be comparatively low (please mind that applying a coating using thermal coating techniques takes a significant time). Of course, different thicknesses can be applied as well. As an example, the thickness can be larger than 10 μm, 20 μm, 30 μm, 50 μm, 75 μm, 100 μm, 125 μm, 150 μm, 170 μm, 200 μm, 225 μm, 250 μm, 275 μm or 300 μm (as a lower limit; 0 is possible as well) and can go additionally and/or alternatively up to 50 μm, 75 μm, 100 μm, 125 μm, 150 μm, 175 μm, 200 μm, 225 μm, 250 μm, 275 μm, 300 μm, 325 μm, 350 μm, 375 μm, 400 μm, 425 μm, 450 μm, 475 μm, 500 μm, 600 μm, 700 μm, 800 μm, 900 μm or 1 mm (as an upper limit).

However, it is also possible that the weight fraction of Mo in the coating layers (at least one of the plurality of coating layers) is different from the previously suggested "at least 1%". In particular, it is suggested that the weight fraction of Mo in the coating layer is at least 2%, 3%, 5%, 15%, 20%, 25%, 30%, 40% or 50% and/or at most 100%, 90%, 80%, 75%, 70%, 60%, 50%, 40%, 30%, 25%, 20%, 15% or 10%. The indicated figures can be applied to one, two, three or even more layers (including essentially all layers), in particular if a plurality of layers is prevalent. This statement shall possibly apply mutatis mutandis to all content indications (with respect to materials, percentages, chemical formulas, sizes (in particular sizes of particles and the like)) that are given in the context of this application, as well. First experiments have shown that the resulting workpiece will show a particularly advantageous overall characteristic, if the indicated percentages are chosen. In particular, the numbers can be chosen in dependence of the specific conditions the workpiece is intended to be used in.

It is further suggested to manufacture the workpiece in a way that the coating layer (at least one of the plurality of coating layers) contains Ni (nickel) with a weight fraction of less than 40%, 35%, 33.3%, 30%, 25%, 20%, 15%, 10%, 9%, 7%, 6%, 5%, 4.5%, 4%, 3.5%, 3%, 2.5%, 2%, 1.5%, 1% or 0.5% or essentially no Ni at all. First experiments have shown that when using a certain content of Mo, the presence of Ni with a too high fraction is surprisingly counterproductive. Therefore, a reduced content of Ni is preferred. Only for completeness: the presently indicated numbers cannot only be used as an upper limit but additionally or alternatively as a lower limit as well.

It is furthermore suggested to design the workpiece in a way that the coating layer (at least one of the plurality of coating layers) also contains at least one material that is taken from the group, comprising Cr (chromium), B (boron), Si (silicon), Fe (iron) and Mn (manganese). First experiments indicate that by using a certain content of these materials (metals), or one can even further improve the characteristics of the coating layer (in particular with respect to the presence of Mo to a certain extent).

Furthermore, it is suggested that the workpiece is designed in a way that the coating layer (at least one of the plurality of coating layers) is essentially a material with the content formula Mo25(NiCrBSiFe), or a derivative thereof, where the weight content of Mo is between 75% and 90%, preferably between 80% and 85% and/or the weight content of Ni is between 2% and 5%, preferably between 3% and 4% and/or the weight content of Cr is between 2% and 5%, preferably between 3% and 4% and/or the weight content of B is between 2% and 5%, preferably between 3% and 4% and/or the weight content of Si is between 2% and 5%, preferably between 3% and 4% and/or the weight content of Fe is between 2% and 5%, preferably between 3% and 4%. First experiments have shown that this particular mixture of materials results in a particularly advantageous coating layer.

Additionally and/or alternatively, it is suggested to design the workpiece in a way that the coating layer (at least one of the plurality of coating layers) is essentially a material with the content formula Fe16Mo2C0.25Mn, or a derivative thereof, where the weight content of Fe is between 75% and 90%, preferably between 80% and 85% and/or the weight content of C is between 0.5% and 2%, preferably between 1% and 1.5% and/or the weight content of Mn is between 3% and 7%, preferably between 4% and 6%. When performing initial experiments, these experiments indicate that the indicated material mix results in a coating layer that is particularly advantageous. The content of Mo is preferably between 15% and 20%, even more preferred between 16% and 18%.

It is further suggested to design the workpiece in a way that the coating layer (at least one of the pluralities of coating layers) contains essentially no Pb (lead). This way, present and future legislation can be advantageously dealt with.

By the notion "essentially no lead" it is meant that it is of course "allowed" that some residuals/impurities that cannot be economically feasibly removed (and that usually do not show a threat to nature) can be present in the respective material. Nevertheless, usually an "intentional content" of lead can be avoided.

According to yet another proposal, the workpiece can be designed in a way that the coating layer (at least one of the plurality of coating layers) is made from a spray material and preferably applied using spray coating methods, in particular thermal spray coating methods, like plasma spraying methods and/or high velocity oxy fuel spraying methods. Such methods are as such known in the state of the art as such (albeit with different materials). Using this proposal, it is possible that presently available machinery (and possibly even machinery that is already used "on site") can be used for the presently proposed coating layer (possibly after some modifications). This possibility increases the acceptance of the presently proposed coating layers. Nevertheless, using these (standard coating) methods, a coating layer of the presently proposed type, showing usually excellent characteristics, can be realised, typically in a comparatively cheap and efficient way.

It is further suggested to design the workpiece in a way that the spray material comprises particles of sizes that are suitable for spray coating methods, in particular in that the spray material comprises particles with sizes in the range from 1 μm to 25 μm, preferably between 5 μm and 15 μm. In the present context, "comprising" can be understood as (essentially) consisting of. Also, a certain percentage of at least 0%, 10%, 20%, 30%, 40%, 50%, 60%, 70%, 80% or 90% up to 10%, 20%, 30%, 40%, 50%, 60%, 70%, 80%, 90% or 100% can be meant as well. The percentage can particularly relate to a weight percentage, to a molar percentage, to a volume percentage or the like. Using particles of such a size, usually the resulting coating layer shows particularly advantageous characteristics; in particular, it is usually very wear resistant. It is to be noted that the particles, although they are a "predecessor material" of the resulting coating layer, will influence the structure of the resulting coating layer in a way that the originally used sizes can still be detected from the resulting coating layer, at least under usually employed operating conditions of the spray coating methods.

The workpieces (and in particular the coating layer/coating layers) can show their intrinsic properties and advantages particularly well, if in the workpiece, the coating layer (at least one of the plurality of coating layers) is present at least at a contacting surface, where the workpiece is movably arranged relative to another workpiece. As already mentioned, this is sort of a "typical minimum requirement". At different regions, a coating layer may or may not be present and/or a coating layer of a different thickness and/or of a different material composition may be foreseen. The "contacting surface" in this context is to be interpreted in a way that a mechanical contact under standard operating conditions (and possibly under operating conditions that are rare—and therefore not standard—but that can occur with a reasonably high level of possibility) is envisaged. In the present context, the notion of a "contacting surface" can particularly mean a direct contact (with no lubricant in between) and/or an "indirect" contact (with a lubricant layer in between).

It is further suggested to design the workpiece in a way that the workpiece is a device, taken from the group comprising swash plates, eccentrics, pistons, piston feet, cylinders, cylinder blocks, valves, valve plates, valve plate devices, valve segment devices, rings, liners, plates, plate devices, bearings, bearing plates and/or bearing plate devices. Such parts are typically particularly prone to mechanical wear. Therefore, the use of a coating layer for such parts is particularly advantageous and will usually result in a very durable "overall machine". This, of course, is usually desired. It is to be noted that even when the notion of a "plate" is used, it is also possible that the respective device has a profound thickness (where usually the notion of a "plate" would not be used). Therefore, for some of the devices listed above, alternative expressions are suggested (like plate device, valve segment, valve segment device). The respective notions have not been used for all possible and thinkable combinations. However, the use shall be possible mutatis mutandis for other devices as well. In particular, the use of "plate" is typically limited to devices with a thickness of up to 1 mm, 2 mm, 3 mm, 4 mm, 5 mm, 6 mm, 7 mm, 8 mm, 9 mm or 10 mm. In the "other direction", plates of a very limited thickness shall be possible as well, where sometimes the notion of a "foil" might already be used (for example for devices of up to 0.1 mm, 0.2 mm, 0.3 mm, 0.4 mm, 0.5 mm, 0.6 mm, 0.7 mm, 0.8 mm, 0.9 mm or 1 mm). Of course, it is clear for a person skilled in the art that the "upper limit" for one device can be interpreted as the "lower limit" for the "consecutive" device.

It is further suggested that the workpiece is designed for use in a hydraulic device, in particular for use in a fluid working machine. In such a case, the respective workpiece can show its intrinsic properties and advantages particularly well, resulting in a likewise advantageous "overall machine".

Furthermore, it is suggested to design a hydraulic device and/or a fluid working machine in a way that it comprises at least one workpiece according to one or several of the previous suggestions. In this case, the hydraulic device/the fluid working machine shows the same characteristics, advantages and features as previously mentioned, at least in analogy. Furthermore, the hydraulic device/fluid working machine can be improved in the previously described sense as well, at least in analogy.

BRIEF DESCRIPTION OF THE DRAWINGS

Further advantages, features, and objects of the invention will be apparent from the following detailed description of the invention in conjunction with the associated drawings, wherein the drawings show.

DETAILED DESCRIPTION

Figure 1:
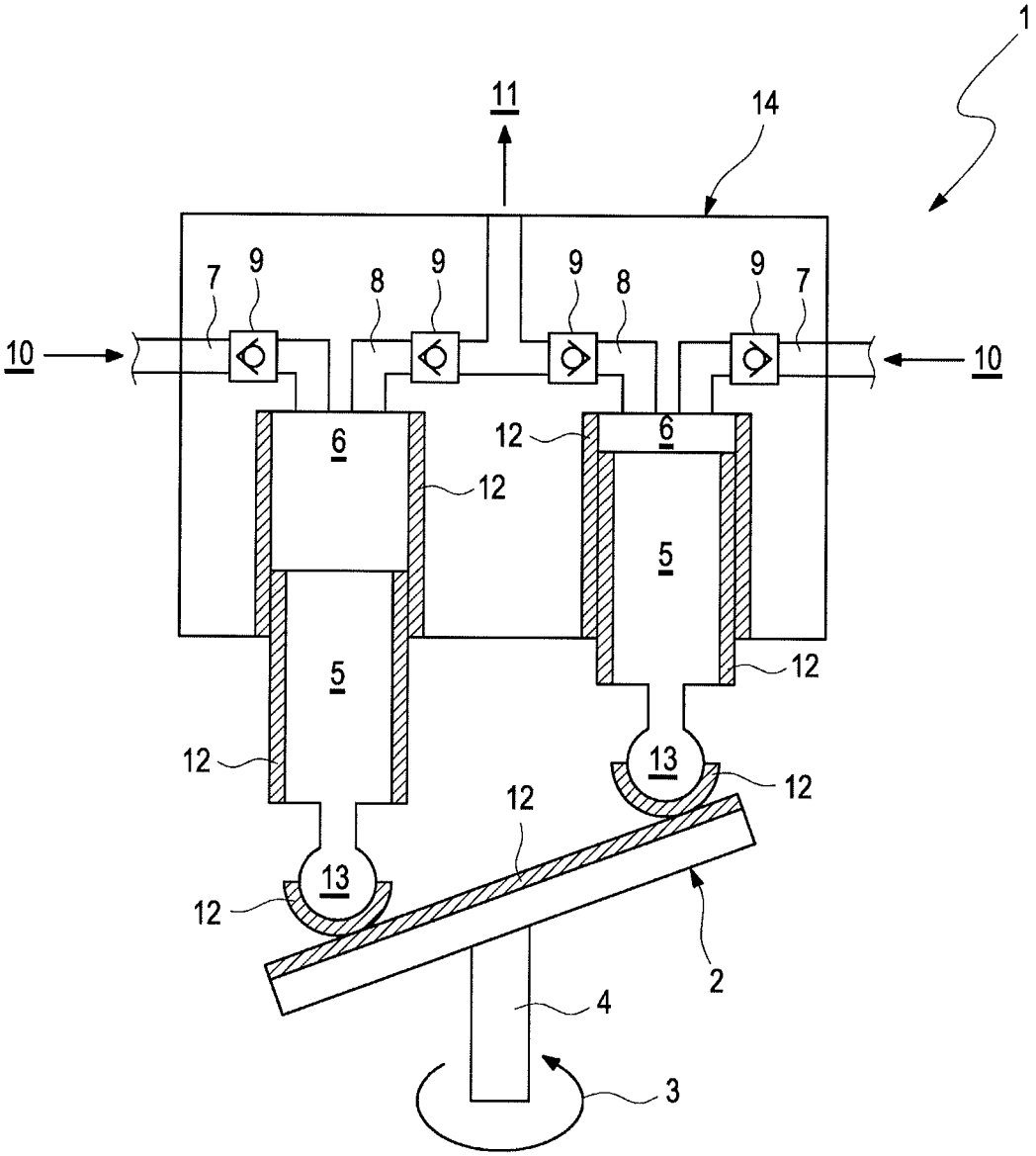
FIG. 1: a possible first embodiment of a fluid working machine comprising several parts, where some of those parts show a partial surface coating, in a schematic cross section.

In FIG. 1, a possible embodiment of a fluid working machine 1 is shown. In the present case, the fluid working machine 1 is of a hydraulic fluid pump type, where a tilted swash plate 2 (frequently addressed as "wobble plate") is used for first converting a rotary movement 3 (indicated by arrow 3 around turning shaft 4) into an up-and-down movement of several pistons 5 that move in their respective cylindrical cavities 6. The cylindrical cavities 6 are arranged in a valve block 14 that remains stationary. By the up-and-down movement of the pistons 5, the volume that is enclosed by the pistons 5 and the cylindrical cavity 6 is repetitively expanding and contracting. Furthermore, fluid inlet channels 7 and fluid outlet channels 8 fluidly connect to the cylindrical cavities 6 with appropriately arranged check valves 9 arranged in the fluid channels 7, 8. As already mentioned, and as it is typical for a fluid working machine 1 of the embodiment shown, the valve block 14 remains (essentially) stationary. However, it is of course not ruled out that the fluid working machine 1 is used for mobile applications. Therefore, in the context of the present application "stationary" or "fixedly" are typically to be interpreted with respect to the imminent environment (for example with respect to the reference frame of a vehicle). As an additional remark, different designs apart from the presently shown design with check valves 9 are certainly possible as well. Just to name another possibility: a valve plate (valve plate device, valve segment, or the like) could be used additionally and/or alternatively.

Based on the repetitive expansion and contraction of the fluid volume enclosed by the cylindrical cavities 6 and the pistons 5, fluid will be pumped from a low pressure reservoir 10 to a high pressure reservoir 11 (presently not shown in detail), when rotary action is performed on the rotating shaft 4. Such a device is as such known in the state of the art.

The invention lies in the surface coating 12 (indicated by hatched areas) that is arranged on parts of the pistons 5 (cylindrical part), parts of the inside walls of the cylindrical cavities 6, parts of the surface of the swash plate 2 and parts of the surface of the contacting balls 13 that are arranged on the lower parts of the pistons 5, where the contacting balls 13 are designed to be in driving contact with the swash plate 2.

It is to be understood that (at least part of) the gist of the invention lies in the various parts that show a surface coating as discussed later on and the surface coating itself.

It has to be also understood that the various surface coatings 12 can of course be applied to different parts and/or for different embodiments of the fluid working machine 1 as well. In particular, when additionally and/or alternatively to the presently shown check valves 9, a valve plate (or similar device) is used, additional and/or other surface parts should preferably show a surface coating (while some surface parts might not need a surface coating any more).

Furthermore, such appropriately coated parts can be used for different machinery as well. To just name a few examples from the technical field of hydraulics: the parts could be used for hydraulic pumps, for hydraulic motors, for combined hydraulic pumps/motors, for fluid working machines (pumps, motors, combined pumps and motors) of various designs like a tilted plate type; a type with a twistable tilted plate; a fluid working machine using an eccentric that is driving piston feet; a fluid working machine with a rotating cylinder block; a fluid working machine with a valve plate (or a similar device); and so on (where a fluid working machine showing a combination of the aforesaid and possibly even more features is possible as well). Surface coatings in the presently shown embodiment have a thickness of some 200 μm (where some variations can of course occur). Furthermore, it is usually not too problematic if the surface coatings 12 show some variations with respect to their thickness. For example, a nominal surface thickness of (let's say) 200 μm show some variations between 190 μm and 210 μm or even 180 μm to 220 μm without resulting in any noticeable adverse effects (at least usually).

The surface coating 12 is presently applied using a plasma spraying technique, a method that is well known in the state of the art. Presently, for plasma spraying particles of a size of some 10 μm are used (with some variations of ±5 μm). However, the invention is not limited to such sizes and/or to a plasma spray coating method. Essentially all coating techniques can be used likewise, in particular HVOF-techniques (high velocity oxy fuel spraying). Additionally and/or alternatively, particles of a different size can be used as well.

In the present embodiment plasma spraying is based on an arc formation between an anode and a cathode, which leads to the ionisation of a reaction gas, forming a plasma. The coating material is introduced into the plasma and melted due to the high temperature it experiences by those conditions. However, the exact details can vary, of course.

The surface coatings 12 of some surface areas of some parts of the fluid working machine 1 are only applied on those surface parts, where a high probability of a sliding contact between two different parts is present (i.e. such surface areas, where during use of the fluid working machine a relative movement between two different surface parts will usually take place).

In the present embodiment, the surface coatings 12 are therefore limited to the upper side of the swash plate 2 (neighbouring the pistons 5 and the block in which the cylindrical cavities 6 are arranged). On this surface side of the swash plate 2, contacting balls 13 that are arranged on the lower side of the various pistons 5 are in driving contact with the (turning) swash plate 2. Furthermore, the lower half spheres of the contacting balls 13 show a surface coating 12 as well. It is easily understandable that by the surface coatings 12 on the upper side of the swash plate 2 and on the lower spherical half of the contacting balls 13 all surface parts of the contacting balls 13 of the swash plate 2 that can come into sliding contact with each other during normal operation conditions of the working machine 1 show a surface coating 12 in between. Therefore, only a sliding contact between surface coatings is present here (where, of course, a dry sliding without any hydraulic oil can occur in certain operating conditions, like in a malfunction of an oil pump, under severe load and/or in very adverse operating conditions and/or when the fluid working machine has just been started and the oil circuit has been not yet been fully established).

Nevertheless, due to the surface coatings 12, even when dry friction between the contacting surfaces occurs, a lower friction and a lower wear occurs as compared to the case, where no surface coating is present and the (typically metal) parts 2, 13 are in direct contact with each other.

The big advantage of the presently used surface coating 12 is that it is essentially lead-free, i.e. that (apart from some residual contaminations) the surface coating does not contain any lead.

As a remark it should be noted that it is even sufficient that the top surface of the swash plate 2 shows only a ring-like coating so that a sliding contact between the contacting balls 13 and the swash plate 2 is only established with surface parts, showing a surface coating. However, applying only a ring on top of the swash plate is usually comparatively difficult to achieve. Therefore, it is usually cheaper to coat the complete top surface of the swash plate 2. Likewise, additional surface parts of the various parts that are shown in FIG. 1 could be covered with a surface coating as well (to name an example, the pistons 5 could be "completely covered" with a surface coating).

As can be seen from FIG. 1, surface coatings 12 are also applied on the (outer) cylindrical surfaces of the pistons 5 and on the (inner) cylindrical surfaces of the cylindrical cavities 6. As it is easily understandable, here a sliding movement between the contacting surfaces of the pistons 5 and the cylindrical cavities 6 occurs when the pistons 5 are moving up and down under typical operating conditions of the fluid working machine 1.

Presently, two specific embodiments of surface coatings 12 have been investigated and measured, and the results have been compared to presently used surface coatings, comprising a bronze layer with a lead content.

In particular, as substance 1 a material with the content formula Mo25 (NiCrBSiFe) was used, while as substance 2, a material with the content formula Fe16Mo2C0.25Mn was used.

The surface coating was applied with a nominal thickness of 200 μm. This was compared to a lead-containing bronze, as it is available in the state of the art. The lead-containing bronze was also applied with a nominal thickness of 200 μm.

All surface coatings have been applied on a C22 steel substrate according to DIN EN 10083-2, consisting of pearlite and ferrite phases. The hardness of the substrate was given by 195±4 HV0.2, and the flatness was quoted to be 13.38±1.08 μm. Measurements showed that the roughness of the respective coatings after lapping is according to table 1.

| | Rpk/μm | Rk/μm | Rvk/μm |
|---|---|---|---|
| Lead-containing bronze | 0.503 ± 0.013 | 1.17 ± 0.013 | 0.666 ± 0.014 |
| Substance 1 | 0.136 ± 0.007 | 0.664 ± 0.01 | 1.57 ± 0.079 |
| Substance 2 | 0.457 ± 0.016 | 1.858 ± 0.031 | 2.356 ± 0.128 |

When measurements were performed, the micro hardness measurements (HV0.2) on the basis of a metallographic cut was 126 for the reference lead-containing bronze layer, while for substance 1 the micro hardness was approximately 500 HV0.2 and for substance 2 the micro hardness was approximately 460 HV0.2. Likewise, the adhesive strength of the thermally sprayed coatings was measured to be 37 $N/mm^2$ for substance 1 and 41 $N/mm^2$ for substance 2.

The seizure test (coefficient of friction against time) showed a coefficient of friction of approximately 0.11 after 60 sec. of test run for both substances (substance 1 and 2) which is almost the same as for lead-containing bronze according to the state of the art (0.11 after 60 sec. as well).

Finally, the critical contact pressure to the end of the seizure test is even advantageous over lead-containing bronze. While the lead-containing bronze layer showed a critical contact pressure of 650 $N/mm^2$, substance 1 showed a critical contact pressure of 1250 $N/mm^2$, while substance 2 showed a critical contact pressure of 1070 $N/mm^2$.

In short, it can be seen that the presently investigated materials, both containing molybdenum to a certain relevant extent, show even mechanical advantages over presently used lead-containing bronze. The advantage of environmental friendliness due to the absence of lead is of course obvious.

Figure 2:
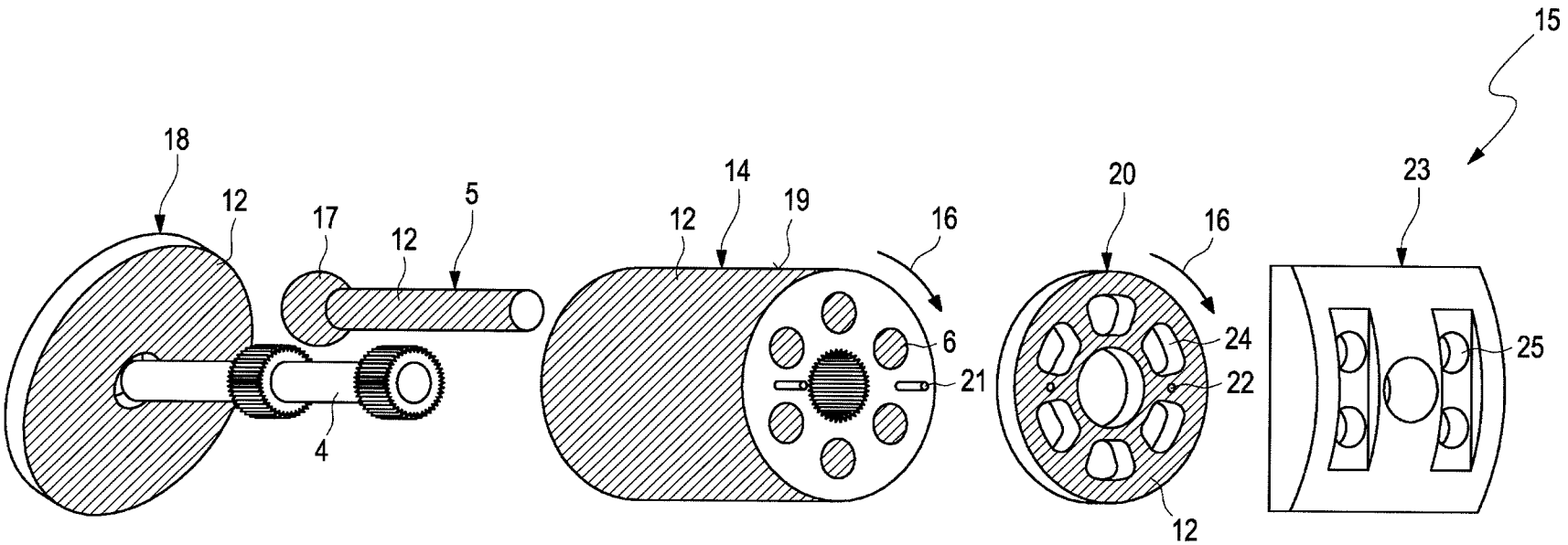
FIG. 2: a possible second embodiment of a fluid working machine comprising several parts, where some of those parts show a partial surface coating, in a schematic exploded view.

As already mentioned above, the afore described and/or presently suggested surface coatings 12 can be advantageously used for other surfaces, parts, devices, surface parts, fluid working machines and/or so on. Therefore, to elucidate the present invention and its advantages and applicability in more detail, in the following, a second possible embodiment of a fluid working machine 15 will be described with reference to FIG. 2. In particular, some kind of a "combination" of the embodiments of a fluid working machine 1 according to FIG. 1 and of a fluid working machine 15 according to FIG. 2 is possible as well (in particular by combining certain features), although this is not explicitly described. Such a "combination" is of course not limited to the presently shown and described embodiments of a fluid working machine 1, 15.

In FIG. 2, a second possible embodiment of a fluid working machine 15, comprising a rotatable cylinder block 14, is shown in a schematic exploded view. For the sake of clarity, some parts are not shown and/or are not shown in detail. Furthermore, for the sake of simplicity, identical reference numerals are used for parts that are similar in function. Therefore, an identical reference numeral does not necessarily imply that the respective parts are identical in function and/or have the same design in both embodiments.

According to the embodiment of FIG. 2, a fluid working machine 15 with a rotatable cylinder block 14 (as indicated by rotating arrows 16) is suggested that shows several surface coatings 12.

In operation, the cylinder block 14 is rotated under the action of a turning shaft 4. Turning shaft 4 and cylinder block 14 are, for example, connected in a torque proof manner, using corresponding protrusions and indentations (for example in toothed wheel like manner). To "compensate" for the now-rotating cylinder block 14 (as compared to the embodiment of FIG. 1), the tilted plate 18, on which the piston feet 17 of the pistons 5 rest (in FIG. 2 only a single piston 5 is shown for simplicity), is now arranged fixedly (i.e. not rotating). This does not necessarily rule out that the angle of the tilted plate 18 can possibly be changed during operation.

When the rotating cylinder block 14 rotates, the pistons 5 are carried along together with the rotating cylinder block 14. Therefore, the piston feet 17 slide along the tilted plate 18 and move up-and-down due to the inclination of the tilted plate 18. Therefore, the pistons 5 move back and forth in their respective cylindrical cavities 6 that are arranged inside the cylinder block 14. This translates into an internal volume of a repetitively changing size that can be used for pumping hydraulic fluid and/or for transforming pressure energy into a movement (similar to the embodiment of a fluid working machine 1 according to FIG. 1).

As a consequence of the rotation of the cylinder block 14, the outer circumferential surface 19 of the cylinder block 14 shows a surface coating 12, since the outer circumferential surface 19 of the cylinder block 14 is in sliding arrangement with a corresponding supporting surface (not shown). Of course, the outer circumferential surfaces of the pistons 5 and the inner circumferential surfaces of the cylindrical cavities 6 show surface coatings 12 as well (necessitated by the sliding contact between the cylindrical cavities 6 and the pistons 5).

In the presently shown embodiment, the cylindrical cavities 6 are designed as simple through bores. It is easy to understand that such a design is particularly simple to manufacture. Therefore, "on top" of the cylinder block 14, a bearing plate 20 is arranged. The bearing plate 20 is fixed in a torque proof (and fluid tight) manner to the cylinder block 14. Thus, the bearing plate 20 rotates together with the cylinder block 14 (as indicated by rotating arrow 16). To realise a simple but effective torque proof connection between the cylinder block 14 and the bearing plate 20, protruding pins 21 that fit into corresponding holes 22 are presently used (of course, different arrangements can be used as well). The bearing plate 20 shows several openings 24, that are typically in fluid connection with the cylindrical cavities 6, but do not have the same cross sections as the cylindrical cavities 6.

On the surface side of the bearing plate 16, lying opposite to the cylinder block 14 (and neighbouring the valve plate 23), a valve plate 23 is arranged. The neighbouring surfaces of the bearing plate 20 and of the valve plate 23 are in sliding contact with each other. Consequently, the respective surfaces are provided with surface coatings 12.

The valve plate 23 is fixedly arranged (i.e. it is not rotating together with the cylinder block 14 and/or the bearing plate 20). As indicated in FIG. 2, the valve plate 23 also shows several openings 25.

The openings 25 in the valve plate 23 and the openings 24 in the bearing plate 20 are designed and arranged in a way that they "mimic the behaviour" of active and/or passive valves when the cylinder block 14/bearing plate 20 rotates with respect to the valve plate 24, so that a pumping behaviour and/or a motoring behaviour of the fluid working machine 15 is realised. Such a design is known as such in the state-of-the-art and presently not further described for brevity.

Thanks to the various surface coatings 12 on the various surface parts of the various parts of the fluid working machine 15, a reliable and wear resistant fluid working machine 15 with a long lifetime and comparatively low friction can be realised.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A hydraulic device comprising a part comprising at least in part a coating layer, wherein the coating layer consists of a weight content of Mo between 80% and 85%, a weight content of Ni between 3% and 4%, a weight content of Cr between 3% and 4%, a weight content of B between 3% and 4%, a weight content of Si between 3% and 4% and a weight content of Fe between 3% and 4%, and wherein the part is movably arranged relative to another part of the hydraulic device.

2. A part for a hydraulic device comprising at least in part a coating layer, wherein the coating layer consists of a weight content of Mo of at least 1%, a weight content of Fe between 75% and 90%, a weight content of C between 0.5% and 2% and a weight content of Mn between 3% and 7%, wherein the part is movably arranged relative to another part of the hydraulic device, wherein the part is in direct contact or in indirect contact with the another part, and wherein indirect contact means there is a layer of lubricant separating the part and the another part.

3. The hydraulic device according claim 1, wherein the coating layer is made from a spray material.

4. The hydraulic device according to claim 3, wherein the spray material comprises particles of sizes in a range from 1 μm to 25 μm.

5. The hydraulic device according to claim 1 wherein the coating layer is present at least at a contacting surface.

6. The hydraulic device according to claim 1, wherein the part is a swash plate, eccentric, piston, piston foot, cylinder, cylinder block, valve, valve plate, valve plate device, valve segment device, ring, liner, plate, bearing or bearing plate device.

7. The hydraulic device according to claim 6, wherein the part is configured for use in a fluid working machine.

8. The hydraulic device according to claim 1, further comprising a second part, the second part comprising at least in part a coating layer, wherein the coating layer consists of a weight content of Mo between 80% and 85%, a weight content of Ni between 3% and 4%, a weight content of Cr between 3% and 4%, a weight content of B between 3% and 4%, a weight content of Si between 3% and 4% and a weight content of Fe between 3% and 4%, and wherein the first part is movably arranged relative to the second part.

9. The part according to claim 2, where the weight content of Fe is between 80% and 85% and/or the weight content of C is between 1% and 1.5% and/or the weight content of Mn is between 4% and 6%.

10. The hydraulic device according to claim 1, wherein the part is in direct contact or in indirect contact with the another part, and wherein indirect contact means there is a layer of lubricant separating the part and the another part.

* * * * *